US009370675B1

(12) United States Patent
Rowe

(10) Patent No.: US 9,370,675 B1
(45) Date of Patent: Jun. 21, 2016

(54) FOAM GENERATING APPARATUS AND METHOD FOR COMPRESSED AIR FOAM SYSTEMS

(76) Inventor: Carroll G. Rowe, Washington, AR (US)

( * ) Notice: Subject to any disclaimer, the term of this patent is extended or adjusted under 35 U.S.C. 154(b) by 316 days.

(21) Appl. No.: 13/041,534

(22) Filed: Mar. 7, 2011

(51) Int. Cl.
*A62C 2/00* (2006.01)
*A62C 5/02* (2006.01)
*A62C 3/06* (2006.01)

(52) U.S. Cl.
CPC .... *A62C 5/02* (2013.01); *A62C 3/06* (2013.01)

(58) Field of Classification Search
CPC ..... B01F 3/04446; Y10S 261/26; A62C 5/02
USPC ..... 169/14, 16, 44; 261/18.1, 78.2, 76
See application file for complete search history.

(56) References Cited

U.S. PATENT DOCUMENTS 4,802,630 A * 2/1989 Kromrey et al. ..... 239/428
5,837,168 A 11/1998 Rowe
6,086,052 A 7/2000 Rowe
6,138,994 A 10/2000 Rowe
6,217,009 B1 4/2001 Rowe

* cited by examiner

*Primary Examiner* — Arthur O Hall
*Assistant Examiner* — Viet Le

(57) ABSTRACT

An apparatus for generating foam for use in a compressed air foam system (CAFS) incorporates two plates housed in a chamber. A surfactant solution enters the chamber through an orifice in one plate. Pressurized air enters the chamber through a number of channels bored through the other plate, the channels appearing in an annular groove which circumscribes the solution inlet. The restricted area between the plates balances the pressure between the incoming solution and air by achieving an equilibrium at some particular radius out from the center of the two plates. A liquid, such as water or a surfactant and water solution, may optionally be introduced through an inlet into the chamber. The resulting mixture is fed through a main outlet positioned along the chamber wall.

9 Claims, 2 Drawing Sheets

FOAM GENERATING APPARATUS AND METHOD FOR COMPRESSED AIR FOAM SYSTEMS

BACKGROUND OF THE INVENTION

Various compressed air foam systems (CAFS) have been used in firefighting for quite some time. The original CAFS developments were made by the U.S. Navy during the 1940's as a method to fight fires on ships. In its most basic form, a CAFS is simply a means for mixing air and water with a surfactant in order to produce a water-based foam that is used to extinguish fires. CAFS provides quicker "knockdown" against potent fires, deeper penetration of fuels, and gives firefighters the advantage of making their initial attack against a fire from a significantly greater distance than with a traditional water stream or fog pattern. The bubble structure allows for greater expansion of delivered water surface area, allowing for greater heat reduction compared to equal amounts of plain water. Foam blankets allow for pre-treatment of fuels that are not already involved in the fire, and have less adverse impact on property, as well as helping to prevent damage to evidence used for fire investigations. In fact, some studies have indicated that CAFS increases the effectiveness of water as an extinguishing agent by approximately a factor of five. CAFS may be particularly valuable for rural fire departments, because the use of foam reduces the amount of water required to extinguish a fire, and rural departments are often quite limited in the amount of water that they have available at any particular fire.

A challenge with CAFS design is the maintenance of a correct balance between incoming water and air pressure. If these pressures are not correctly balanced, a low-quality foam, or even no foam at all, may result. The art includes a number of devices intended to manually or automatically balance the incoming water and air pressure in a mixing chamber in order to produce high-quality foam in a CAFS. The inventor hereof has developed previous systems intended to balance air and water pressure to produce high-quality OAFS foam. Examples are described in U.S. Pat. Nos. 5,837,168; 6,086,052; 6,138,994; and 6,217,009, each of which are incorporated herein by reference. Devices based on the descriptions provided in these patents have been marketed by Rowe Industries of Hope, Ark. under the Equalizer® trademark.

One problem raised by the widespread adoption of OAFS is the cost of retrofitting existing water-based systems to employ OAFS equipment. Since rural fire departments are generally not as well funded as many urban fire departments, the replacement of an existing, fully functional water-based pumper truck with one featuring an integrated OAFS unit is often cost prohibitive. For this reason, there is currently a significant demand for retrofitting of standard water-only pumper trucks with OAFS equipment. A problem arises, however, in that the OAFS equipment may not fit neatly within the available space on an existing pumper truck, which complicates the retrofit process and increases the associated cost.

Another problem raised by the adoption of OAFS systems is that there may be certain applications where, even though a OAFS system is available, it is desirable to use only water in fighting a particular fire. For example, this may be desired if solution is not immediately available. It would be advantageous if the OAFS system could simply be deactivated in the field without the removal of any equipment, and most importantly that the resulting unit would be capable of full, unrestricted water flow to the hose nozzle despite the presence of the in-line OAFS system. Likewise, it would be advantageous if the OAFS system allowed for the relatively unrestricted flow of solution rather than water, where "solution" is a combination of water and surfactant without the injection of air to produce foam. Solution has been shown to be more effective than simple water in suppressing certain types of fires, and there are firefighting applications where it is deemed more desirable than OAFS. A further advantage would be to allow for the combination of either water or solution flow with OAFS production to produce a "wet OAFS" flow, thereby giving the firefighter a full selection of operating modes that may be utilized in order to best address a particular firefighting scenario arising in the field. It would also be desirable to develop such a system without the need for complex bypass piping, in order to keep the cost of the retrofit as low as possible and minimize the on-board space required for the retrofit.

What is desired then is an improved OAFS foam generator that can be easily and inexpensively retrofitted to existing liquid-only systems, and is operable in various modes as required for various firefighting applications, without significant lowering of liquid flow in non-OAFS modes despite the presence of the additional OAFS components.

BRIEF SUMMARY OF THE INVENTION

The present invention is a OAFS foam generator that is particularly suited for retrofit OAFS applications and which does not significantly restrict the flow of liquid through the system when operated in a non-OAFS mode.

In one aspect, the invention is directed to an apparatus for generating foam in a compressed air foam system (OAFS), the apparatus comprising a chamber comprising a chamber wall; a first plate positioned within the chamber; a solution inlet passing through the chamber wall and the first plate; a second plate positioned within the chamber and parallel to the first plate, wherein a restricted area is formed between the first and second plates; an air inlet passing through the chamber wall; an air nozzle positioned on the second plate; an air passage connecting the air inlet and air nozzle; a main inlet passing through the chamber wall, wherein the main inlet is positioned to deliver a liquid into the chamber; and a main outlet passing through the chamber wall.

In another aspect, the invention is directed to a method for generating foam in a OAFS, the method comprising introducing solution into a chamber, wherein the solution passes through a solution inlet and a first plate; introducing air into the chamber, wherein the air passes through an air inlet, an air passage, and an air nozzle in a second plate; introducing a liquid into the chamber, wherein the liquid passes through a main inlet into the chamber, and wherein the liquid, solution, and air are mixed in the chamber to form a wet foam; and delivering the wet foam out of the chamber through a main outlet.

In still another aspect, the invention is directed to an apparatus for generating foam in a OAFS, the apparatus comprising a cylindrical chamber comprising a first end, second end, and sidewall; a first plate mounted within the chamber, wherein the first plate is positioned parallel to the first and second ends of the chamber; a solution inlet passing through the first chamber end and into the first plate; a second plate mounted within the chamber, wherein the second plate is positioned parallel to the first plate and the first and second ends of the chamber, such that a restricted area is formed between the first and second plates, and wherein the second plate further comprises a circular groove; an air inlet passing through the second end of the chamber; an air manifold connected to the second plate and the second end of the chamber; a plurality of air nozzles positioned in a circular pattern on and passing through the groove on the second plate, wherein the air nozzles are connected to the air manifold; a main inlet passing through the sidewall of the chamber, wherein the main inlet is positioned to deliver a liquid into the chamber, and wherein the main inlet is positioned perpendicular to the air nozzles and the solution inlet; and a main outlet passing through the chamber sidewall.

These and other features, objects and advantages of the present invention will become better understood from consideration of the following detailed description of the preferred embodiments, in conjunction with the drawings as described immediately below.

DETAILED DESCRIPTION OF THE PREFERRED EMBODIMENTS

Figure 1:
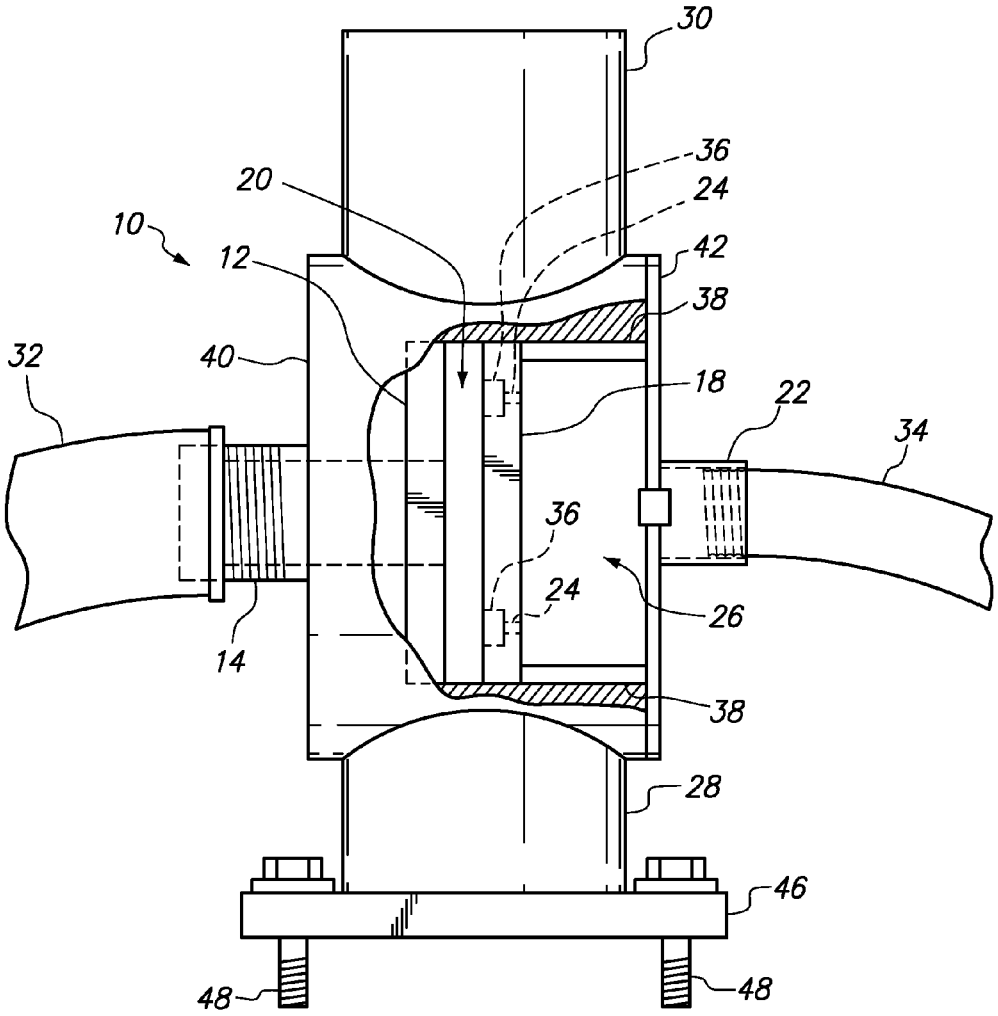
FIG. 1 is a side elevational view in partial cut-away of a mixing chamber and attached hoses according to a preferred embodiment of the present invention.

The preferred embodiment of the present invention may now be described with reference to FIGS. 1 and 2. A mixing chamber 10 serves as the location where the mixing of solution and air takes place in order to produce CAFS foam. Chamber 10 is preferably mounted on a firefighting vehicle, although the invention is not so limited. Chamber 10 is of a generally cylindrical shape, having a circular first end 40, a circular second end 42, and an annular sidewall 44. Each of circular first end 40, circular second end 42, and annular sidewall 44 may collectively be referred to as the "chamber wall" herein. Chamber 10 is preferably formed entirely of a strong, rust-resistant metal alloy, such as stainless steel, although brass and other materials may be substituted in alternative embodiments.

Solution inlet 14 passes through first end 40 of chamber 10, and allows for the introduction of solution into chamber 10. The solution is fed to solution inlet 14 through solution hose 32. Outside threads on solution inlet 14 and inside threads on the fitting at the end of solution hose 32 allow for a secure, leak-free connection. Solution may be delivered through solution hose 32 from an on-board solution reservoir (not shown), as well known in the art.

Air inlet 22 passes through second end 42 of chamber 10, and allows for the introduction of pressurized air into chamber 10. Pressurized air is directed to air inlet 22 through air hose 34. Inside threads on air inlet 22 and outside threads on the fitting at the end of air hose 34 allow for a secure, leak-free connection. Pressurized air may be delivered through air hose 34 from an on-board air compressor (not shown), as well known in the art.

Firefighting water or solution is delivered to chamber 10 by means of main inlet 28, which passes through chamber sidewall 44. In the preferred embodiment, main inlet 28 is connected to a standard water pipe (not shown) in any size as commonly used on firefighting vehicles. Mounting plate 46 provides a convenient means to connect chamber 10 directly to the valve in a liquid delivery system of a firefighting vehicle by means of bolts 48. In the preferred embodiment, mounting plate 46 and bolts 48 are sized to fit with standard valve assemblies for water pipes as commonly used on firefighting vehicles, thereby simplifying the installation and retrofitting of a OAFS-utilizing chamber 10 to an existing firefighting vehicle. It may also be seen that this arrangement serves to lessen the space requirements for the installation or retrofitting of chamber 10 in a firefighting vehicle, because no special fitting is required if mounting plate 46 is connected directly to an existing valve assembly. Since space for the installation of additional equipment is often severely limited on firefighting vehicles, those skilled in the art will recognize the advantages of this compact design. In alternative embodiments, however, mounting plate 46 may be omitted, and main inlet 28 may be connected to the system in other ways, including but not limited to by means of a direct threaded connection with system piping, or a pipe coupling such as produced by the Victaulic Company of Easton, Pa.

As will be described further herein, main inlet 28 may be used to delivery either water or solution to chamber 10. If solution is being delivered, it may be drawn from the same solution reservoir that feeds solution hose 32, or may be fed from a separate source. Water may be delivered either from an on-board reservoir or from an external source, such external sources including but not being limited to a water truck or water hydrant. If flow through main inlet 28 is not desired in a particular application, then the valve (not shown) to which mounting plate 46 is attached by means of bolts 48 may simply be closed; in this case, only OAFS will be produced by the preferred embodiment, as described more fully herein.

Foam or liquid, depending upon the mode of operation, exits chamber 10 by means of main outlet 30, which also passes through sidewall 44 of chamber 10. Main outlet 30 is preferably positioned in a diametrically opposite position to main inlet 28, in order to provide the minimum flow resistance through chamber 10, but may alternatively be positioned at any point on chamber 10. It may be seen that with the arrangement described herein, there is no need to provide any bypass mechanism when liquid—either water or solution—rather than OAFS foam is desired for a particular firefighting application. By simply stopping the flow of solution through surfactant hose 32 and the flow of pressurized air through air hose 34 by means of appropriate valves, as are well known in the art, chamber 10 will become a simple pass-through device, such that liquid entering chamber 10 through main inlet 28 will pass with little impedance out through main outlet 30. Again, since installation space is often severely limited on firefighting vehicles, it will be seen by those skilled in the art that the elimination of bypass piping and valves is a significant advantage of the present design. This feature of the preferred embodiment also serves to reduce the cost of a OAFS system installation.

Figure 2:
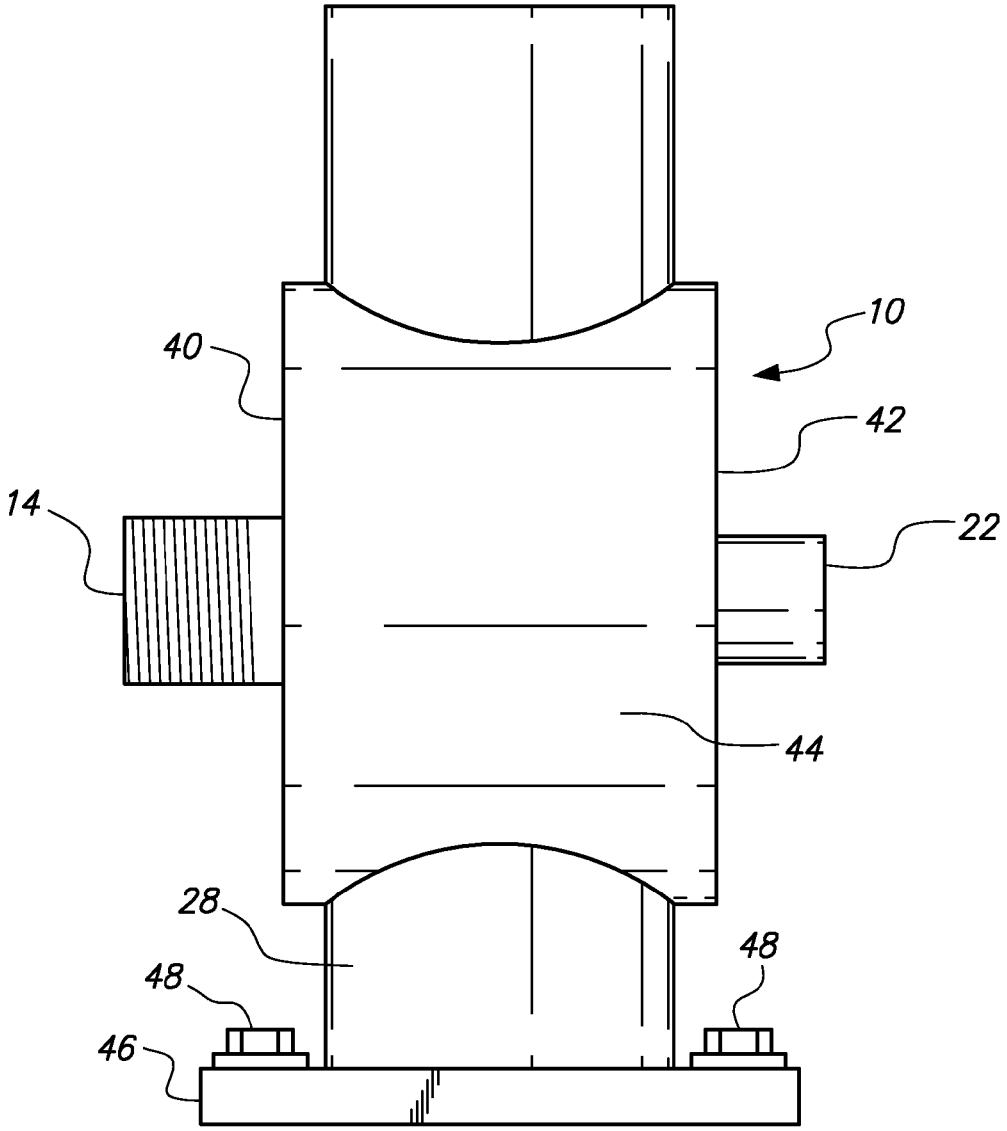
FIG. 2 is a side elevational view of a mixing chamber according to a preferred embodiment of the present invention.

Turning now specifically to FIG. 1, the internal components that facilitate foam production within chamber 10 may now be described. First plate 12 and second plate 18 are mounted within chamber 10. They are preferably round in shape, but of a lesser diameter than chamber first end 40 and second end 42, such that there is space within chamber 10 around the outer periphery of first plate 12 and second plate 18. They are preferably positioned in close proximity to each other, thereby forming restricted space 20 therebetween. In the preferred embodiment, the spacing between first plate 12 and second plate 18 is about ¼", but the invention is not so limited, and other spacings may be employed in alternative embodiments, thereby varying the volume of restricted space 20.

Solution inlet 14 feeds through chamber first end 40 and then through an opening in first plate 12, such that surfactant solution may be fed directly into the center area of restricted space 20. Solution inlet 14 also serves as the means for mounting first plate 12 within chamber 10. In the preferred embodiment, solution inlet 14 and first plate 12 are welded together, although other means of attachment, as well known in the art, may be employed in alternative embodiments.

Second plate 18 is connected to chamber second end 42 by means of air manifold wall 38. Air manifold wall 38 is of annular shape, with an outer diameter that matches the diameter of second plate 18. It may be seen then that by connecting second plate 18 to chamber send end 42 with air manifold wall 38, a generally closed space is formed behind second plate 18 and within air manifold wall 38. This closed space will be referred to herein as air manifold 26. An opening between chamber second end 42 and air inlet 22 allows pressurized air to flow from air hose 34 into air manifold 26. Air inlet 22, chamber second end 42, air manifold wall 38, and second plate 18 are all preferably connected by welding, but other means of attachment, as well known in the art, may be employed in alternative embodiments.

Pressurized air that reaches air manifold 26 exits through air nozzles 24 in second plate 18. Air nozzles 24 may simply be small openings passing through second plate 18. They may be straight-sided openings, or conical or tapered openings, in various embodiments, and may either be set at a right angle to the plane of second plate 18, or angled inwardly or outwardly. The number and size of air nozzles 24 may similarly be varied. It will be seen that air nozzles 24 allow pressurized air to pass into restricted area 20. Air nozzles 24 exit through second plate 18 within annular groove 36, which appears on that face of second plate 18. The width, depth, and diameter of annular groove 36 may be varied, as desired for best OAFS foam production. Regardless, it will be understood then that pressurized air may pass from air hose 34 through air inlet 22, air manifold 26, and air nozzles 24, passing out into restricted area 20 by means of groove 36. The result of the arrangement as herein described is that surfactant solution enters restricted area 20 at its center, pressurized air reaches restricted area 20 nearer to its periphery, and mixing of solution and air thus takes place (as will be described following) along a circumference within restricted area 20 that is of lesser diameter than groove 36.

The structure of the preferred embodiment having now been described, its operation in a first mode for the production of only OAFS foam may be discussed with continued reference specifically to FIG. 1. The flow of solution to solution hose 32 and pressurized air to air hose 34 are initiated by opening appropriate valves, as known in the art. (The valve that feeds main inlet 28 remains closed in this first mode of operation.) While the incoming static pressure of solution is generally set to a level in excess of the incoming static air pressure, the difference is not critical, due to the self-regulating nature of the preferred embodiment, as will be described below. By balancing the pressure of incoming surfactant solution and air, thorough mixing of the two streams results. The volume of solution and air in this mixture will determine the degree to which a "wet" foam or "dry" foam is produced. The foam exits at main outlet 30. It may then be directed by pipes and hoses to a nozzle (not shown), as well known in the art, for firefighting applications.

The principle of operation for the production of OAFS foam in the preferred embodiment, as understood by the inventor hereof, will now be described. The design of the preferred embodiment is intended to provide a thorough mixing of surfactant solution and pressurized air, without the need to continuously monitor and adjust the incoming surfactant solution pressure and air pressure. The pressure at any point within restricted area 20 is believed to vary based primarily on the distance from the center of restricted area 20 at which the pressure is measured. The pressure near the periphery of restricted area 20, near air nozzles 24, is believed to largely be determined by the air pressure passing through air nozzles 24, which is determined in part by the incoming air pressure, the diameter of air hose 34 and air inlet 22, the volume of air manifold 26, the size and shape of air nozzles 24, and the backpressure at main outlet 30. The pressure at the center of restricted area 20 is believed to largely be determined by the incoming surfactant solution pressure, the diameter of solution hose 32 and solution inlet 14, and the backpressure at main outlet 30. It will be seen that the backpressure at the periphery of restricted area 20 is higher than atmospheric pressure, but lower than the pressure at solution inlet 14 or air inlet 22. It is believed that a balanced pressure between the air and solution is reached at some radial point between groove 36 and solution inlet 14, within restricted area 20. This equilibrium point, lying along a circumference within groove 36, will shift radially between groove 36 and solution inlet 14 depending on the incoming surfactant solution and air pressures, thus finding a balance point between the two. This balance of pressure allows for thorough mixing, and thus the production of a high-quality OAFS foam. The balancing of solution pressure and air pressure is therefore automatic, without the need for intervention or monitoring by the user.

In a second mode of operation, no OAFS foam is produced, and chamber 10 effectively operates as a pass-through device. The valves controlling flow to solution inlet 14 and air inlet 22 remain closed in this mode. The valve controlling flow to main inlet 28, however, is opened. Depending upon the configuration and/or desire of the operator, either solution or simple water may be directed through main inlet 28 and into chamber 10. Because of the design of the preferred embodiment, it will be seen that even though the OAFS system is not in operation in this mode, the elements that provide OAFS foam production provide very little resistance to the flow of liquid from main inlet 28, through chamber 10, and out through main outlet 30. This mode thus operates essentially the same as if no OAFS system were in place at all.

In a third mode of operation, flow is opened through all three of solution inlet 14, air inlet 22, and main inlet 28. This mode may thus be thought of as a combination of the first and second modes of operation, where OAFS foam is produced, but additional solution or water is also being added to chamber 10 simultaneously with the production of OAFS foam. By controlling the volume of liquid (solution or water) introduced at main inlet 28, additional control may be maintained over the wet or dry characteristics of the resulting foam that exits main outlet 30. It may be seen, for example, that the introduction of a greater volume of water or solution through main inlet 28 will result in a wetter foam, which is desirable for certain firefighting applications.

Finally, in what may be characterized as a fourth mode of operation, it may be seen that when the flow to solution inlet 14, air inlet 22, and main inlet 28 are all stopped by operation of the appropriate valves, then there will be no production of liquid or foam at main outlet 30. This is thus an "off" configuration for the preferred embodiment.

While the preferred embodiment has been described with reference to OAFS firefighting equipment, it may be understood by those skilled in the art that the invention is not so limited. The invention finds application wherever it is desirable to produce a thorough mixture of gas and one or more liquids.

As used herein, "comprising" is synonymous with "including," "containing," or "characterized by," and is inclusive or open-ended and does not exclude additional, unrecited elements or method steps. As used herein, "consisting of"

excludes any element, step, or ingredients not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims.

In general the terms and phrases used herein have their art-recognized meaning, which can be found by reference to standard texts, journal references and contexts known to those skilled in the art. The preceding definitions are provided to clarify their specific use in the context of the invention. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention as set forth in the appended claims.

The invention claimed is:

1. An apparatus for generating foam in a compressed air foam system (CAFS), the apparatus comprising:

(a) a chamber comprising a chamber wall;

(b) a first plate positioned within the chamber;

(c) a solution inlet passing through the chamber wall and the first plate;

(d) a second plate positioned within the chamber and parallel to the first plate, wherein a restricted area is formed between the first and second plates, and wherein the second plate comprises a second plate center and a plurality of air nozzles each positioned radially outward from the second plate center;

(e) an air inlet passing through the chamber wall;

(f) an air passage connecting the air inlet and the plurality of air nozzles, wherein the air passage comprises an open, cylindrically-shaped air manifold formed by an annular air manifold wall extending from the second plate to the chamber wall and forming an entirely open space between the second plate and the chamber wall and within the air manifold wall, wherein the annular air manifold wall comprises an air manifold wall outer diameter equal to a diameter of the second plate all along the air manifold wall outer diameter, and wherein the air manifold directly connects the air inlet to the plurality of air nozzles whereby air may travel from the air inlet out through the plurality of air nozzles;

(g) a main inlet passing through the chamber wall, wherein the main inlet is positioned to deliver a liquid into the chamber; and (h) a main outlet passing through the chamber wall;

wherein the chamber comprises a minimum chamber cross-sectional area measured perpendicular to at least one of the main inlet or the main outlet, the main inlet comprises an inlet cross-sectional area, and the main outlet comprises an outlet cross-sectional area, wherein the minimum chamber cross-sectional area is at least as large as the inlet cross-sectional area the outlet cross-sectional area.

2. The apparatus of claim 1, wherein the main outlet is positioned diametrically opposite to the main inlet.

3. The apparatus of claim 1, wherein the first plate comprises a first plate center and the solution inlet is positioned at the first plate center.

4. The apparatus of claim 1, wherein the first and second plate centers are aligned along a common axis.

5. The apparatus of claim 1, wherein the second plate further comprises an annular groove, and wherein the plurality of air nozzles are positioned within the annular groove.

6. The apparatus of claim 5, wherein the first and second plates are circular.

7. The apparatus of claim 6, wherein the chamber is cylindrical, and the first and second plates are positioned within the chamber such that a longitudinal axis of the chamber passes through the first plate center and second plate center.

8. An apparatus for generating foam in a compressed air foam system (CAFS), the apparatus comprising a cylindrical chamber comprising a first end, second end, and sidewall; a first plate mounted within the chamber, wherein the first plate is positioned parallel to the first and second ends of the chamber; a solution inlet passing through the first chamber end and into the first plate; a second plate mounted within the chamber, wherein the second plate is positioned parallel to the first plate and the first and second ends of the chamber, such that a restricted area is formed between the first and second plates, and wherein the second plate further comprises a circular groove; an air inlet passing through the second end of the chamber; an open, cylindrically shaped air manifold connected to the second plate and the second end of the chamber, wherein the air manifold is formed by an annular air manifold wall extending from the second plate to the cylindrical chamber second end and forming an entirely open space between the second plate and the cylindrical chamber second end and within the air manifold wall, wherein the air manifold wall comprises an air manifold wall outer diameter equal to a diameter of the second plate, and wherein the air manifold directly connects the air inlet to a plurality of air nozzles positioned in a circular pattern on and passing through the groove of the second plate whereby air may travel from the air inlet out through the plurality of air nozzles; a main inlet passing through the sidewall of the chamber, wherein the main inlet is positioned to deliver a liquid into the chamber, and wherein the main inlet is positioned perpendicular to the plurality of air nozzles and the solution inlet; and a main outlet passing through the chamber sidewall, wherein the cylindrical chamber comprises a minimum chamber cross-sectional area measured perpendicular to the main inlet and the main outlet, the main inlet comprises an inlet cross-sectional area and the main outlet comprises an outlet-cross-sectional area, and wherein the minimum chamber cross-sectional area is at least the same as the inlet cross-sectional area and at least the same as the outlet cross-sectional area.

9. The apparatus of claim 8, wherein the main inlet is positioned to direct the liquid into the chamber in a direction parallel to the first and second plates.

* * * * *